United States Patent [19]

Skinner et al.

[11] Patent Number: 4,872,814

[45] Date of Patent: Oct. 10, 1989

[54] VARIABLE DISPLACEMENT COMPRESSOR PASSIVE DESTROKER

[75] Inventors: Timothy J. Skinner, E. Amherst; Joseph L. Spurney, Tonawanda; Weiming Ma, Williamsville, all of N.Y.

[73] Assignee: General Motors Corporation, Detroit, Mich.

[21] Appl. No.: 204,338

[22] Filed: Jun. 9, 1988

[51] Int. Cl.[4] ..... F04B 1/26

[52] U.S. Cl. ..... 417/222; 417/269; 417/294

[58] Field of Search ..... 417/222 S, 269, 270, 417/294; 74/60

[56] References Cited

U.S. PATENT DOCUMENTS

| | | | |
|---|---|---|---|
| 2,706,384 | 4/1955 | Schott | 74/60 |
| 3,289,590 | 12/1966 | Hutcheon | 417/294 |
| 3,785,754 | 1/1574 | Miller | 417/213 |
| 4,351,152 | 9/1982 | Reynolds et al. | 60/395 |
| 4,395,199 | 7/1983 | Izumi et al. | 417/53 |
| 4,487,109 | 12/1984 | Burandt et al. | 91/506 |
| 4,494,911 | 1/1985 | Davis | 417/222 |
| 4,526,516 | 7/1985 | Swain et al. | 417/222 |
| 4,533,299 | 8/1985 | Swain et al. | 417/222 |
| 4,606,705 | 8/1986 | Parekh | 417/222 |

FOREIGN PATENT DOCUMENTS

| | | | |
|---|---|---|---|
| 228592 | 4/1987 | Japan | 417/222 S |

*Primary Examiner*—William L. Freeh

*Attorney, Agent, or Firm*—R. L. Phillips

[57] ABSTRACT

A passive destroker mechanism operated by centrifugal force is added to a variable stroke axial piston wobble plate refrigerant compressor. The destroker operates at a predetermined compressor speed to communicate the discharge side of the compressor with its sealed crankcase to thereby provide a controlled discharge gas bleed thereto to destroke the compressor to a desired displacement. Then after the speed is reduced below such trigger speed, the destroker mechanism operates to return the compressor to its normal stroke control condition.

2 Claims, 3 Drawing Sheets

VARIABLE DISPLACEMENT COMPRESSOR PASSIVE DESTROKER

TECHNICAL FIELD

This invention relates to compressors that are driven at varying speed and have a variable piston stroke and thereby displacement that is controlled by pressurizing the crankcase using fluid discharge pressure and controlling the crankcase pressure relative to suction pressure. More particularly, this invention relates to a motor vehicle air conditioning compressor that is driven by a motor vehicle's engine and is of the axial piston wobble plate type having a tiltable wobble plate mechanism that connects with the pistons and is located in a sealed crankcase with stroke increase effected by control means that connects the compressor's discharge cavity to the crankcase thereby to effect pressure increase therein tending to tilt the wobble plate mechanism toward a zero piston stroke position and further operates to connect the compressor's suction cavity to the crankcase thereby to effect a pressure decrease therein tending to tilt the wobble plate mechanism toward a maximum piston stroke position.

BACKGROUND OF THE INVENTION

In variable displacement refrigerant compressors such as those of the variable angle wobble plate type used in motor vehicle air conditioning systems, it has been found desirable for extended compressor life expectancy to destroke or reduce the compressor displacement at high speed operation. One proposed solution is to add a solenoid valve that operates above a prescribed compressor speed to control a conventional stroke control valve so as to increase the crankcase pressure to discharge pressure to thereby effect minimum piston stroke and thereby minimum displacement to prolong compressor life. This proposal is disclosed in U.S. Pat. No. 4,606,705 assigned to the assignee of the present invention. While such an arrangement has proven generally satisfactory, there remains an alternative desire for a passive type destroker that would reduce the compressor displacement during certain high speed operation to improve the durability of the compressor mechanism while maintaining some compressor displacement and thereby air conditioning potential.

SUMMARY OF THE INVENTION

According to the present invention, a centrifugal stroke valve mechanism is connected in parallel with a conventional stroke control valve arrangement and is attached mechanically onto the compressor shaft so as to both slide and rotate in contact with an existing compressor part (i.e. the suction reed disk). The passive destroke mechanism includes a counterweighted valve member that rotates with the compressor shaft and at a predetermined trigger speed develops a centrifugal force that overrides a spring and friction force to slide the valve member from a closed to an open position. In the open position, a flow path in created between the discharge or high pressure side of the compressor and the crankcase to thereby allow a controlled discharge gas to bleed into the crankcase to destroke the compressor to a desired low displacement with the control effect accomplished by close control of the size of the delivery port. On the other hand, when the speed of the compressor is eventually reduced to the trigger speed, the centrifugal force is thereby reduced and overridden by the spring force so that the valve member then slides back towards its normal closed position wherein the compressor then operates as normal under the conventional stroke control valve arrangement.

In a preferred embodiment, the passive destroker mechanism makes maximum use of existing compressor componentry and in addition takes advantage of existing space in the compressor so as to not require any increase in the overall compressor dimensions which is highly desirable from a packaging standpoint. Moreover, only simple modifications are then required of the existing compressor structure to accommodate the new passive destroker mechanism.

It is therefore an object of the present invention to provide a new and improved speed responsive destroker for a variable stroke axial piston wobble plate compressor.

Another object is to provide in a variable stroke axial piston wobble plate compressor, a passive destroker mechanism that operates with centrifugal force to control the pressure in the compressor's crankcase and thereby destroke the compressor to a desired displacement at a predetermined compressor speed while maintaining some compressor displacement and thereby refrigeration potential.

Another object is to provide in a variable stroke axial piston wobble plate compressor having a conventional stroke control valve arrangement that controls pressure in the crankcase to thereby effect stroke control, a passive destroker valve mechanism connected in parallel with the conventional stroke control valve and responsive to compressor speed such as to communicate discharge gas with the crankcase so as to destroke the compressor at a predetermined high compressor speed while maintaining some compressor displacement and thereby refrigeration potential.

These and other objects, advantages and features of the present invention will become more apparent from the following description and drawing in which:

Detailed Description of the Preferred Embodiment

Figure 1:
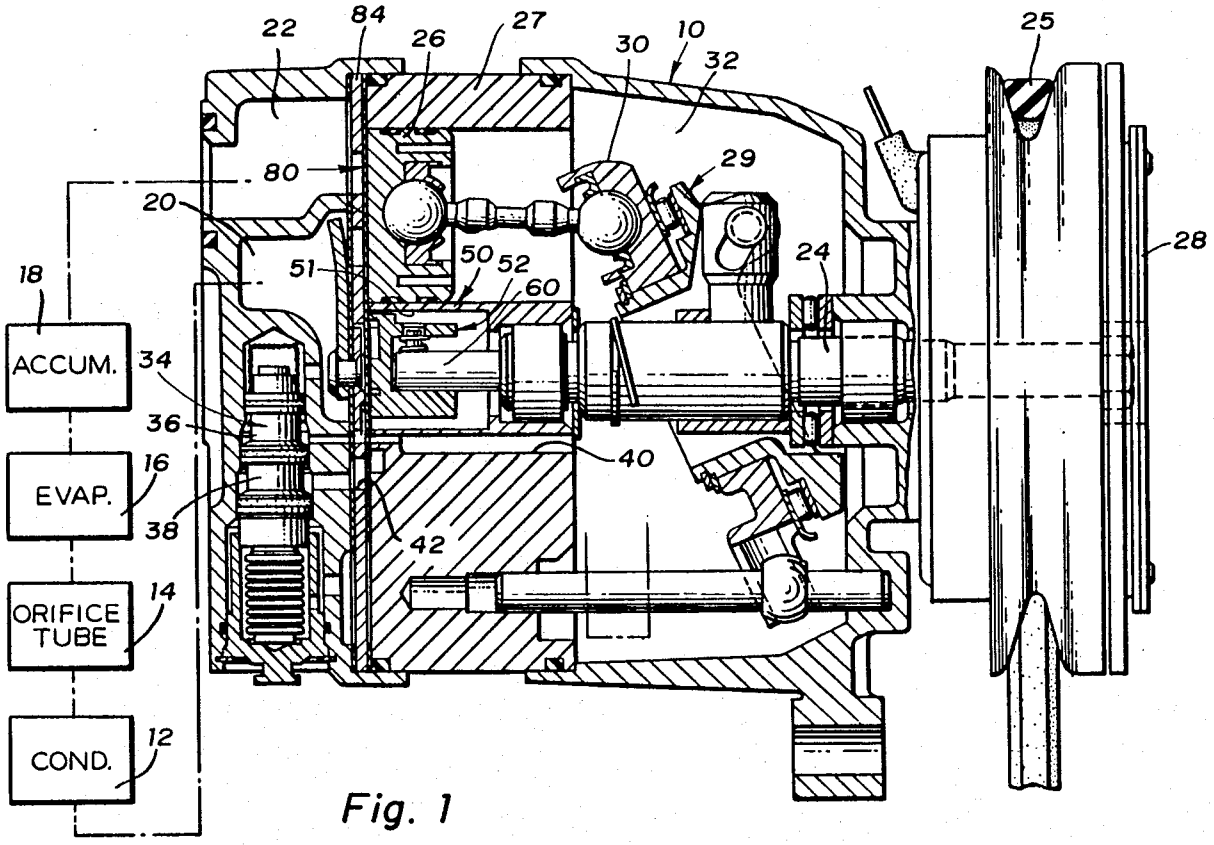
FIG. 1 is a cross-sectional view of a variable displacement refrigerant compressor of a variable angle wobble plate type having incorporated therein a preferred embodiment of the passive destroker valve mechanism according to the present invention. This figure further includes a schematic of a motor vehicle air conditioning system in which the compressor is connected.

Referring to FIG. 1, there is shown a variable displacement refrigerant compressor 10 of the variable angle wobble plate type connected in a motor vehicle air conditioning system having the normal condenser 12, orifice tube 14, evaporator 16 and accumulator 18 arranged that order between the compressor's discharge cavity 20 and suction cavity 22.

The compressor has a drive shaft 24 driven at a varying speed by the vehicle's engine (not shown) through a drive belt 25 and the operation of an electromagnetic clutch 29. Five pistons 26, (only one being shown) mounted in the compressor's cylinder block 27 and connected to be driven by the shaft through a tiltable wobble plate mechanism 28. The stroke of the pistons and thereby the displacement of the compressor is determined by the operating angle of this mechanism whose wobble plate 30 is made to angulate by pressurizing the sealed crankcase 32 using the refrigerant discharge pressure and controlling the pressure in the crankcase relative to suction pressure with a displacement control valve arrangement 34. The control valve arrangement 34 comprises a stroke decrease control valve means 36 and a stroke increase control valve valve means 38 that are responsive to both discharge pressure and suction pressure such as to communicate the crankcase with the respective discharge and suction cavities 20 and 22 via a discharge passage 40 and suction passage 42, respectively, to increase the piston stroke and thereby displacement and discharge flow rate with both increasing suction and discharge pressures.

The details of the compressor 10 thus far described is like that disclosed in U.S. Pat. Nos. 4,428,718 and 4,480,964 and assigned to the assignee of the present invention and which are hereby incorporated by reference. However, it is also contemplated that the displacement control valve arrangement might also take the form of entirely separate valves and also an electronic control valve responsive to suction and discharge pressures and other parameters such as temperature and speed affecting the air conditioning conditions and requirements.

Figure 2:
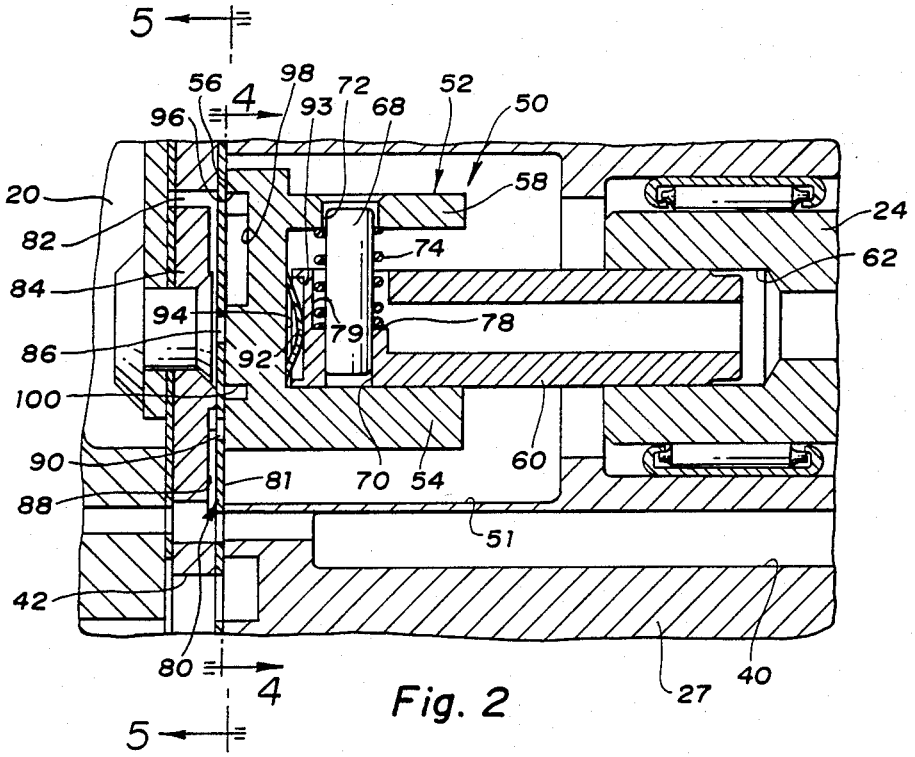
FIG. 2 is an enlarged view of the passive destroker valve mechanism in FIG. 1 wherein the destroker valve is in its closed position.
Figure 3:
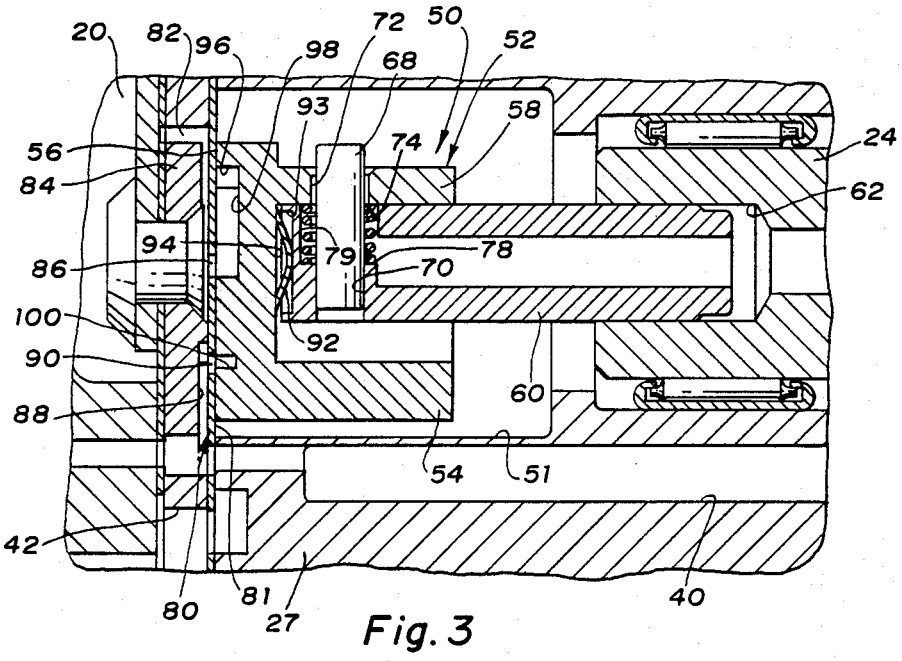
FIG. 3 is a view similar to FIG. 2 but showing the destroker valve in its open position effecting destroking of the compressor.
Figure 4:
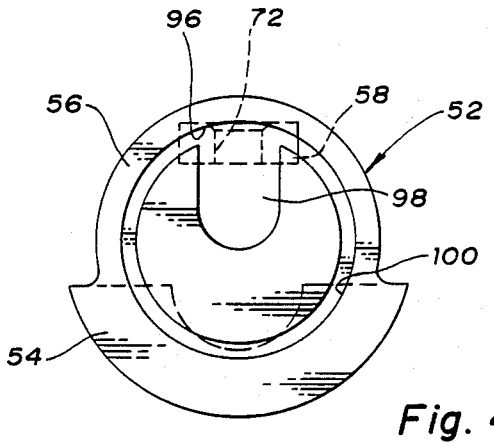
FIG. 4 is a view taken along the line 4—4 in FIG. 2.
Figure 5:
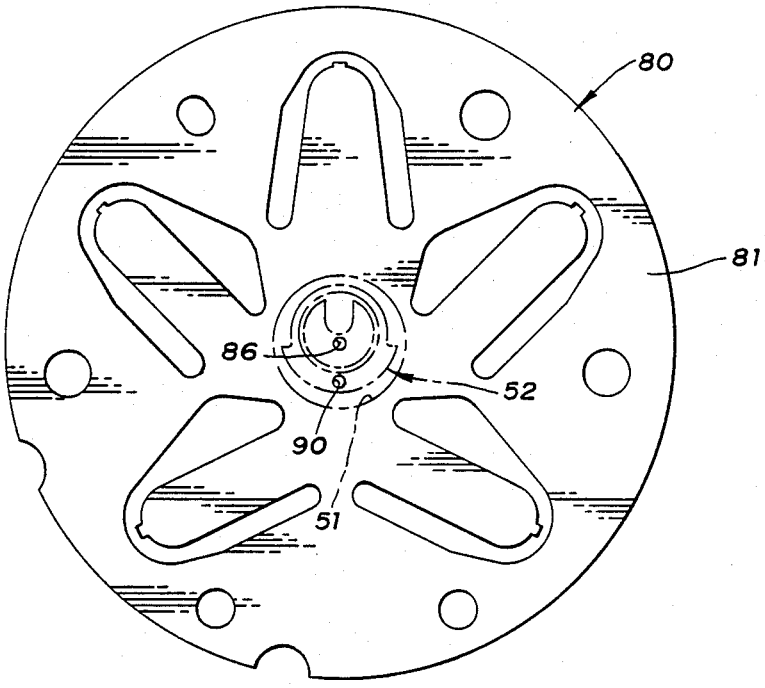
FIG. 5 is a view taken along the line 5—5 in FIG. 2.

According to the present invention, the compressor 10 is provided with a passive destroker mechanism 50 which As best seen in FIGS. 2–5 is received within an enlarged counterbore 51 in the cylinder block 27 and comprises a disk-shaped valve member 52 having a counterweight portion 54 (see FIG. 4), a flat radial valve face 56 at one end (see FIG. 4) and an axially extending arm 58 (see FIGS. 2 and 4). The valve member 52 receives with substantial radial clearance between its counterweight portion 54 and arm 58 an added end portion 60 of the drive shaft 24 formed by a cylindrical hollow pin that is press-fitted in a bore 62 in this end of the drive shaft. A drive pin 68 operatively drivingly connects the valve member to the drive shaft end portion 60 for rotation thereby and guides radial movement of the valve member relative to the shaft. To this end, the pin 68 is press-fitted in a radial bore 70 in the left end portion of the drive pin 60 and is slidably received in a radial bore 72 through the arm 58 of the valve member 52.

A coil spring 74 is arranged about the pin 68 between the arm 58 and a spring seat 78 formed by a counterbore 79 in the cross bore 70 that also freely accommodates the outer diameter of the spring at this end. The valve spring 74 is preloaded to normally urge contact of the drive shaft extension 60 and the counterbore surface 58 to establish the valve member in the closed valve position shown in FIGS. 1 and 2 and is yieldable in response to centrifugal force generated by the counterweight portion at a predetermined shaft speed (also referred to herein as the trigger speed) to permit centrifugally forced movement of the valve member from such closed position to the open position shown in FIG. 3.

Utilization is made of the compressor's normal suction reed valve disk 80 which has a flat surface 81 facing the valve member's valve face 56.

The destroker's valve passages comprise a regulating passage 82 that is formed in the compressor's normal valve plate 84 and is permanently open to the discharge cavity 20 and extends through the flat surface of the suction reed valve disk 80 at a port 86 that is in central axial alignment with the compressor shaft as seen in FIGS. 2–5. In addition, there is formed a delivery passage 88 in the valve plate that is permanently open to the crankcase 32 via the existing passage 40 and extends through the flat surface of the suction reed valve disk at a port 90 that is located radially outwardly of the regulating passage port 86 as seen in FIGS. 2–5. A dish-shaped spring 92 arranged between the bottom of a central axial blind bore 93 in the left end of the drive shaft pin 60 and the backside 94 of the valve member 52 continuously forces sealing contact of the valve member's valve face 56 with the flat surface 81 of the suction valve disk 80. As seen in FIGS. 2 and 4, the valve face 56 is formed with an endless channel 96 therein comprising a radial portion 98 that extends radially to the center of the valve face thereby to be positioned to be closed to the regulating passage port 86 by contact of the valve face with the suction valve reed surface 80 when the valve is in its closed position shown in FIG. 2 and to be continuously opened thereto during rotation of the valve member with the shaft when the valve member is in its open valve position shown in FIG. 3.

The endless channel 96 further has a circular portion 100 that is concentric with the valve member's blind bore 58 and intersects with the radial channel portion 98 radially outward of the valve face center and is radially positioned thereby to be closed to the delivery passage port 86 by contact of the valve face 56 with the suction reed valve surface 81 when the destroker valve is in its closed position in FIG. 2 and to be continuously opened thereto during rotation of the valve member with the compressor shaft when the valve is in its open position in FIG. 3. Thus, the endless channel 96 effects communication between the discharge cavity and the crankcase only when the valve member 52 is urged by centrifugal force to its open position at a predetermined shaft or trigger speed.

For the desired operation, the destroker mechanism 50 which rotates with the compressor shaft is calibrated with its integral counterweight 54 and the biasing spring 74 so that at a predetermined trigger speed (that high compressor speed beyond which compressor mechanism durability significantly falls off) there is created sufficient centrifugal force that will override this spring and the friction force between the valve face and suction valve disk and cause the valve member to slide radially outward with respect to the drive shaft pin 60 from its normally closed position in FIG. 2 to its open position in FIG. 3. On establishment of the latter, there is created a flow path between the discharge cavity 20 of the compressor and the sealed crankcase 32 thereby to allow a controlled discharge gas to bleed into the crankcase and destroke the compressor a desired amount so as to maintain some compressor displacement and thereby air conditioning potential. This stroke control effect is predetermined by close control of the size of the port 86. The reduced stroke and thereby the reduced compressor displacement at this high speed operates to improve the durability of the compressor mechanism by reducing the work then required thereof while maintaining some compressor displacement and thereby air conditioning potential. Then eventually as the speed of the compressor is reduced to below the predetermined trigger speed, the centrifugal force is correspondingly reduced and overridden by the force of the spring 74 such that the latter then reestablishes the valve destroker member back 52 in its normal closed operating position wherein the compressor then operates as normal under the control of the conventional stroke control valve 36 and 38.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiments was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The embodiments of the invention in which an exclusive property or privilege is claimed are defined as follows:

1. A variable stroke axial piston wobble plate compressor comprising a suction cavity, a discharge cavity, a sealed crankcase, a drive shaft extending through said crankcase, a tiltable wobble plate mechanism in said crankcase mounted on and driven by said drive shaft, stroke increase control valve means for connecting said discharge cavity to said crankcase thereby to affect pressure increase therein tending to tilt said wobble plate mechanism toward a zero piston stroke position, stroke decrease control valve means for connecting said suction cavity to said crankcase thereby to affect a pressure decrease therein tending to tilt said wobble plate mechanism toward a maximum piston stroke position, said compressor being characterized by a valve member having a counterweight portion and a flat valve face, said valve member receiving an end portion of said shaft with substantial radial clearance therebetween, drive means operatively drivingly connecting said valve member to said end portion for rotation therewith and guiding radial movement of said valve member relative to said shaft, a spring arranged so as to normally urge contact of said end portion and valve member thereby to normally establish said valve member in a closed valve position and yieldable in response to centrifugal force generated by said counterweight portion at a predetermined shaft speed to permit centrifugally forced movement of said valve member to an open valve position, a compressor part having a flat surface facing said valve face, a regulating passage permanently open to said discharge cavity and extending through said flat surface at a port in central axial alignment with said shaft, a delivery passage permanently open to said crankcase and extending through said flat surface at a port radially outward of said regulating passage port, a spring arranged between said shaft end portion and said valve member continuously forcing sealing contact of said valve face with said flat surface of said compressor part, said valve face having channel means therein positioned to be closed to said regulating passage port by contact of said valve face with said flat surface in said closed valve position and to be continuously open thereto during rotation of said valve member with said shaft when said valve member is in said open valve position, said channel means further positioned to be closed to said delivery passage port by contact of said valve face with said flat surface in said closed valve position and to be continuously open thereto during rotation of said valve member with said shaft when said valve member is in said open valve position whereby said channel means effects communication between said discharge cavity and said crankcase only when said valve member is urged by centrifugal force to said open valve position at said predetermined shaft speed.

2. A variable stroke axial piston wobble plate compressor comprising a suction cavity, a discharge cavity, a sealed crankcase, a drive shaft extending through said crankcase, a tiltable wobble plate mechanism in said crankcase mounted on and driven by said drive shaft, stroke increase control valve means for connecting said discharge cavity to said crankcase thereby to affect pressure increase therein tending to tilt said wobble plate mechanism toward a zero piston stroke position, stroke decrease control valve means for connecting said suction cavity to said crankcase thereby to affect a pressure decrease therein tending to tilt said wobble plate mechanism toward a maximum piston stroke position, said compressor being characterized by a valve member having a counterweight portion and a flat radial valve face, said valve member receiving an end portion of said shaft with substantial radial clearance therebetween, a drive pin operatively drivingly connecting said valve member to said end portion for rotation therewith and guiding radial movement of said valve member relative to said shaft, a spring arranged between said end portion and said valve member so as to normally urge contact of said end portion and valve member thereby to normally establish said valve member in a closed valve position and yieldable in response to centrifugal force generated by said counterweight portion at a predetermined shaft speed to permit centrifugally forced movement of said valve member to an open valve position, a suction reed valve disk having a flat surface facing said valve face, a regulating passage permanently open to said discharge cavity and extending through said flat surface at a port in central axial alignment with said shaft, a delivery passage permanently open to said crankcase and extending through said flat surface of said valve disk at a port radially outward of that of said regulating passage, a spring arranged between said shaft end portion and said valve member continuously forcing sealing contact of said valve face with said flat surface of said valve disk, said valve face having an endless channel therein comprising a radial portion that extends radially to the center of said valve face thereby to be positioned to be closed to said regulating passage port by contact of said valve face with said flat surface in said closed valve position and to be continuously open thereto during rotation of said valve member with said shaft when said valve member is in said open valve position, said endless channel further having an annular portion that intersects with said radial portion radially outward of said valve face center and is radially positioned thereby to be closed to said delivery passage port by contact of said valve face with said flat surface in said closed valve position and to be continuously open thereto during rotation of said valve member with said shaft when said valve member is in said open valve position whereby said endless channel effects communication between said discharge cavity and said crankcase only when said valve member is urged by centrifugal force to said open valve position at said predetermined shaft speed.

* * * * *